US010290978B2

(12) United States Patent
Park et al.

(10) Patent No.: US 10,290,978 B2
(45) Date of Patent: May 14, 2019

(54) FEMALE CONNECTOR, CONNECTOR MODULE HAVING THE FEMALE CONNECTOR AND ELECTRONIC DEVICE HAVING THE CONNECTOR MODULE

(71) Applicant: SOLUM CO., LTD., Yongin-si (KR)

(72) Inventors: Jong Sik Park, Suwon-si (KR); Dae Hyun Jang, Suwon-si (KR); Chang Min Seo, Osan-si (KR)

(73) Assignee: SOLUM CO., LTD., Yongin-Si (KR)

( * ) Notice: Subject to any disclaimer, the term of this patent is extended or adjusted under 35 U.S.C. 154(b) by 0 days.

(21) Appl. No.: 15/634,571

(22) Filed: Jun. 27, 2017

(65) Prior Publication Data

US 2018/0013238 A1 Jan. 11, 2018

(30) Foreign Application Priority Data

Jul. 8, 2016 (KR) ..... 10-2016-0086639

(51) Int. Cl.
*H01R 13/00* (2006.01)
*H01R 13/641* (2006.01)
(Continued)

(52) U.S. Cl.
CPC ..... *H01R 13/641* (2013.01); *H01R 13/115* (2013.01); *H01R 13/622* (2013.01); *H01R 13/6616* (2013.01); *H01R 13/6633* (2013.01); *H01R 13/6675* (2013.01); *H01R 13/6683* (2013.01); *H01R 13/6691* (2013.01); *H01R 13/7038* (2013.01); *H01R 24/76* (2013.01); *H01R 24/46* (2013.01);
(Continued)

(58) Field of Classification Search
CPC .. H01R 2103/00; H01R 24/40; H01R 24/564; H01R 9/0501; H01R 9/0524; H01R 9/0518
USPC ..... 439/578, 583, 490
See application file for complete search history.

(56) References Cited

U.S. PATENT DOCUMENTS 4,180,301 A * 12/1979 Hutter ..... H01R 9/0518 439/271
4,995,814 A * 2/1991 Weidler ..... H01R 25/162 439/513
(Continued)

FOREIGN PATENT DOCUMENTS

JP 1994-268468 A 9/1994
KR 10-2011-0036396 A 4/2011

*Primary Examiner* — Hien D Vu

(57) ABSTRACT

A female connector capable of easily confirming whether or not a male connector is connected thereto, a connector module having the male connector, and an electronic device having the connector module are disclosed. The female connector comprises a connector body, a first terminal engagement pin and a second terminal engagement pin. The first terminal engagement pin is disposed inside the connector body and capable of receiving an input signal from a connection terminal of a male connector when the connection terminal is in contact therewith. The second terminal engaging pin is disposed inside the connector body to be spaced apart from the first terminal engaging pin. The first and second terminal engagement pins are electrically connected with each other through the connection terminal when the connection terminal is inserted and coupled between the first and second terminal engagement pins.

8 Claims, 6 Drawing Sheets

(51) Int. Cl.

| | |
|---|---|
| ***H01R 13/115*** | (2006.01) |
| ***H01R 13/622*** | (2006.01) |
| ***H01R 13/66*** | (2006.01) |
| ***H01R 24/76*** | (2011.01) |
| ***H01R 13/703*** | (2006.01) |
| *H01R 101/00* | (2006.01) |
| *H01R 103/00* | (2006.01) |
| *H01R 24/46* | (2011.01) |

(52) U.S. Cl.
CPC ..... *H01R 2101/00* (2013.01); *H01R 2103/00* (2013.01); *H01R 2201/18* (2013.01)

(56) References Cited

U.S. PATENT DOCUMENTS

| | | | | |
|---|---|---|---|---|
| 7,214,095 | B1 * | 5/2007 | Mathews | H01R 13/5202 439/274 |
| 7,916,875 | B2 * | 3/2011 | Kanji | H01R 29/00 381/58 |
| 8,210,866 | B2 * | 7/2012 | Inage | H01R 13/641 439/188 |
| 9,859,665 | B2 * | 1/2018 | Rohr | H01R 13/7038 |
| 2004/0082218 | A1 * | 4/2004 | Stirling | H01R 13/5219 439/587 |
| 2007/0087627 | A1 | 4/2007 | Mathews | |

* cited by examiner

FEMALE CONNECTOR, CONNECTOR MODULE HAVING THE FEMALE CONNECTOR AND ELECTRONIC DEVICE HAVING THE CONNECTOR MODULE

CROSS REFERENCE TO RELATED APPLICATION

This application claims priority from and the benefit of Korean Patent Applications No. 10-2016-0086639, filed on Jul. 8, 2016, which is hereby incorporated by reference for all purposes as if fully set forth herein.

BACKGROUND OF THE INVENTION

Field of the Invention

The present invention relates to a female connector, a connector module having the female connector and an electronic device having the connector module, more specifically to a female connector to be connected to a male connector for receiving a signal, a connector module having the female connector and an electronic device having the connector module.

Discussion of the Background

The electronic device can perform a certain operation by using self-stored data or perform an operation by receiving a signal from the outside. At this time, the electronic device may receive a signal wirelessly from the outside, but generally may receive a signal through a cable line.

For example, a TV, which is one of electronic devices, can receive a broadcast signal such as a terrestrial broadcast signal, a cable broadcast signal, a satellite broadcast signal, and the like through a cable line to display an image. More specifically, a male connector is installed at a cable line for transmitting the broadcast signal, and a female connector is installed at the TV, so that the male connector can be inserted into the female connector and connected thereto. Therefore, a broadcast signal can be smoothly transmitted to the TV.

On the other hand, in general, an electronic device may not operate properly due to various reasons. One of the causes is that the electronic device is not connected to the cable line or the contact is poor even if it is connected. That is, the male connector of the cable line may not be inserted or connected to the female connector of the electronic device, or may be connected in a defective manner. However, the user cannot easily confirm the failure of such a connection state, and it is inconvenient to grasp the cause of the malfunction of the electronic device.

SUMMARY OF THE INVENTION

Accordingly, the present invention has been made to solve the above problems, and it is an object of the present invention to provide a female connector which can easily check whether or not the male connector is connected.

Another object of the present invention is to provide a connector module having the female connector.

It is still another object of the present invention to provide an electronic device having the connector module.

A female connector according to an embodiment of the present invention comprises a connector body, a first terminal engagement pin and a second terminal engagement pin.

The first terminal engagement pin is disposed inside the connector body and capable of receiving an input signal from a connection terminal of a male connector when the connection terminal is in contact therewith. The second terminal engaging pin is disposed inside the connector body to be spaced apart from the first terminal engaging pin. The first and second terminal engagement pins are electrically connected with each other through the connection terminal when the connection terminal is inserted and coupled between the first and second terminal engagement pins.

The first and second terminal engagement pins may have elasticity so that a distance between the first and second terminal engagement pins increases when the connection terminal is inserted therebetween and the first and second terminal engagement pins returns to the original position when the connection terminal is removed.

The connector body may comprise an outer body and a pin fixing part.

The outer body may have a first opening formed in a first side into which the connection terminal is inserted, a second opening formed in a second side opposite to the first side, and an inner space formed between the first and second openings. The pin fixing part may be disposed in the inner space and fixes the first and second terminal engagement pins.

The pin fixing part may be disposed at a side of the second opening in the internal space, and each of the first and second terminal engagement pins may extend in a direction from the first opening to the second opening through the pin fixing part and the second opening.

The connector body may further comprise an inner body part disposed at a first opening side in the internal space. One end portion of the inner body part may be inserted between the outer body and the pin fixing part to fix the pin fixing part, and the inner body part may have a receiving hole for receiving the first and second terminal engagement pins.

A connector module according to an embodiment of the present invention comprises a female connector and a connector circuit.

The female connector comprises a connector body, a first terminal engagement pin disposed inside the connector body and capable of receiving an input signal from a connection terminal of a male connector when the connection terminal is in contact therewith, and a second terminal engaging pin disposed inside the connector body to be spaced apart from the first terminal engaging pin, wherein the first and second terminal engagement pins are electrically connected with each other through the connection terminal when the connection terminal is inserted and coupled between the first and second terminal engagement pins. The connector circuit is electrically connected to each of the first and second terminal engagement pins.

A first voltage may be formed on the second terminal engagement pin when the second terminal engagement pin is not electrically connected to the first terminal engagement pin, and a second voltage different from the first voltage may be formed in the second terminal engagement pin when the second terminal engagement pin is electrically connected to the first terminal engagement pin through the connection terminal.

The connector circuit may comprise a signal receiving unit electrically connected to the first terminal engagement pin to receive the input signal from the first terminal engagement pin, a power supply unit for providing a DC voltage, a resistor unit electrically connecting the second terminal engagement pin and the power supply unit, and a ground unit being electrically connected to and providing a ground voltage to the first terminal engagement pin. The connector circuit may further comprise an inductor unit electrically connecting the first terminal engagement pin and the ground unit. In this case, the first voltage may be a high level voltage, and the second voltage may be a voltage of a low level.

Alternatively, the connector circuit may comprise a signal receiving unit electrically connected to the first terminal engagement pin to receive the input signal from the first terminal engagement pin, a ground unit providing a ground voltage, a resistor unit electrically connecting the second terminal engagement pin and the ground unit, and a power supply unit being electrically connected to and providing a DC voltage to the first terminal engagement pin. The connector circuit may further comprise an inductor unit electrically connecting the first terminal engagement pin and the power supply unit. In this case, the first voltage may be a low level voltage, and the second voltage may be a voltage of a high level.

An electronic device according to an embodiment of the present invention comprises a connector module and a signal processing module.

The connector module comprises a female connector and a connector circuit. The female connector comprises a connector body, a first terminal engagement pin disposed inside the connector body and capable of receiving an input signal from a connection terminal of a male connector when the connection terminal is in contact therewith, and a second terminal engaging pin disposed inside the connector body to be spaced apart from the first terminal engaging pin, wherein the first and second terminal engagement pins are electrically connected with each other through the connection terminal when the connection terminal is inserted and coupled between the first and second terminal engagement pins. The connector circuit is electrically connected to each of the first and second terminal engagement pins. The signal processing unit is electrically connected to the connector circuit to receive the input signal to process a signal. The signal processing module is capable of indicating whether or not the female connector is connected to the male connector.

The signal processing module may comprise a voltage sensing unit, an indicating unit and a signal processing unit. The voltage sensing unit is electrically connected to the connector circuit to sense a voltage formed on the second terminal engagement pin, and to output a control signal depending on whether or not the female connector is connected to the male connector in response to the sensed voltage. The indicating unit is capable of outputting light. The signal processing unit is capable of processing a signal in response to the input signal provided from the connector circuit and controlling the indicating unit to indicate whether or not the female connector is connected to the male connector in response to the control signal provided from the voltage sensing unit.

The indicating unit may comprise a display device controlled by the signal processing unit and capable of displaying an image according to the input signal or indicating whether or not the female connector is connected to the male connector according to the control signal.

A first voltage may be formed on the second terminal engagement pin when the second terminal engagement pin is not electrically connected to the first terminal engagement pin, and a second voltage different from the first voltage may be formed on the second terminal engagement pin when the second terminal engagement pin is electrically connected to the first terminal engagement pin through the connection terminal.

The connector circuit may comprise a signal receiving unit electrically connected to the first terminal engagement pin to receive the input signal from the first terminal engagement pin, a power supply unit for providing a DC voltage, a resistor unit electrically connecting the second terminal engagement pin and the power supply unit, and a ground unit being electrically connected to and providing a ground voltage to the first terminal engagement pin.

Alternatively, the connector circuit may comprise a signal receiving unit electrically connected to the first terminal engagement pin to receive the input signal from the first terminal engagement pin, a ground unit providing a ground voltage, a resistor unit electrically connecting the second terminal engagement pin and the ground unit, and a power supply unit being electrically connected to and providing a DC voltage to the first terminal engagement pin.

As described above, according to the embodiments, when the connection terminal of the male connector is inserted and coupled between the first and second terminal engagement pins of the female connector, the first and second terminal engagement pins may be electrically connected through the connection terminal so that the voltage formed on the second terminal engagement pin may be changed. Then, when the voltage sensing unit senses a change in the voltage formed on the second terminal engagement pin to determine whether or not the female connector is connected to the male connector, the signal processing unit controls the indicating unit to indicate whether or not the female connector is connected to the male connector. Accordingly, a user using the electronic device can easily recognize the connector connection state by checking the indicating unit.

DETAILED DESCRIPTION OF THE ILLUSTRATED EMBODIMENTS

The present invention is described more fully hereinafter with reference to the accompanying drawings, in which example embodiments of the present invention are shown. The present invention may, however, be embodied in many different forms and should not be construed as limited to the example embodiments set forth herein. Rather, these example embodiments are provided so that this disclosure will be thorough and complete, and will fully convey the scope of the present invention to those skilled in the art.

It will be understood that, although the terms first, second, third etc. may be used herein to describe various elements, components, regions, layers and/or sections, these elements, components, and/or sections should not be limited by these terms. These terms are only used to distinguish one element, component, region, layer or section from another region, layer or section. Thus, a first element, component, or section discussed below could be termed a second element, component, or section without departing from the teachings of the present invention.

The terminology used herein is for the purpose of describing particular example embodiments only and is not intended to be limiting of the present invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Hereinafter, exemplary embodiments of the present invention will be described in detail with reference to the accompanying drawings.

Embodiment 1

Figure 1:
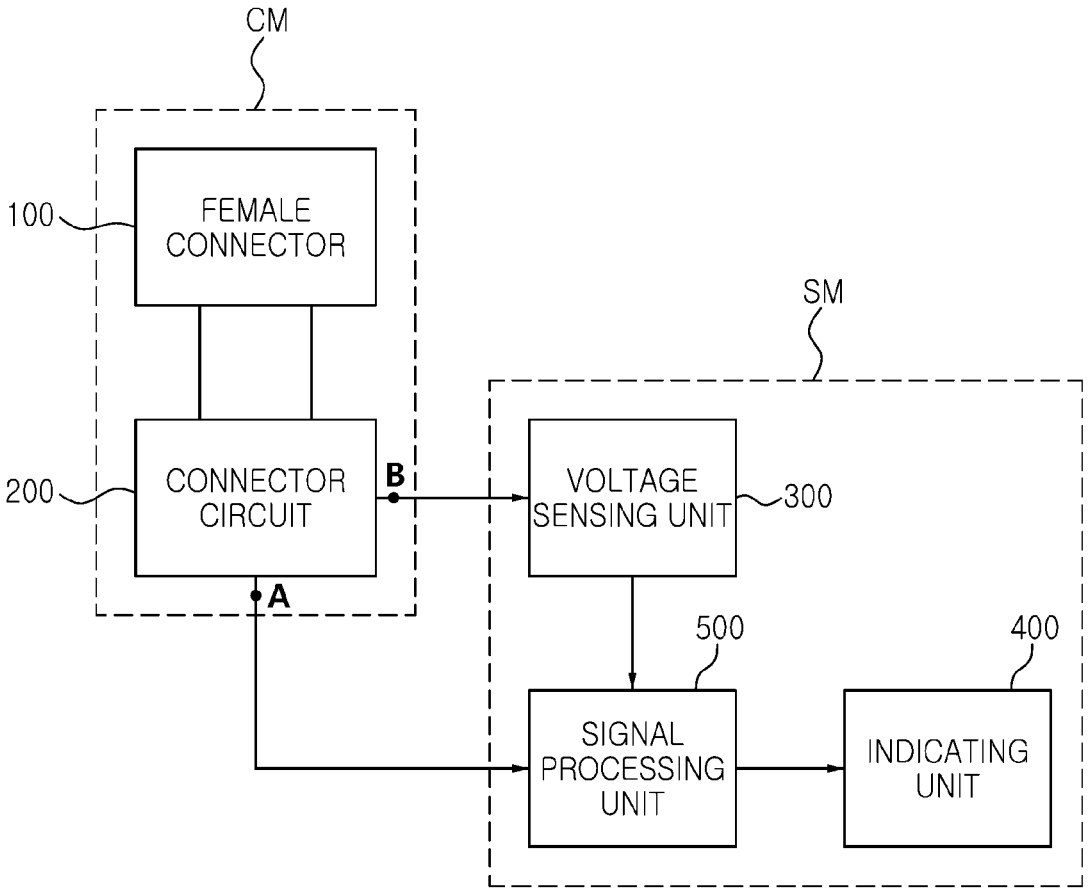
FIG. 1 is a block diagram showing an electronic device according to a first embodiment of the present invention.
Figure 2:
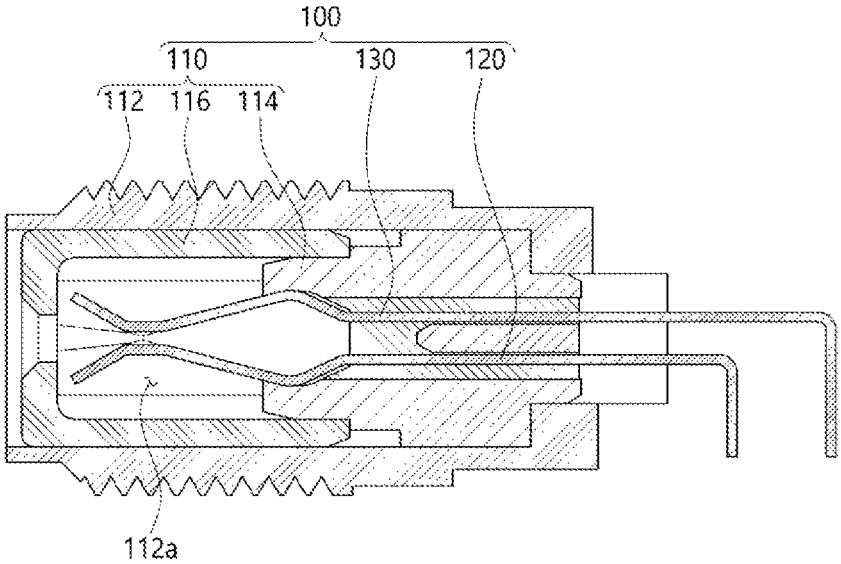
FIG. 2 is a sectional view showing the female connector of FIG. 1.
Figure 3:
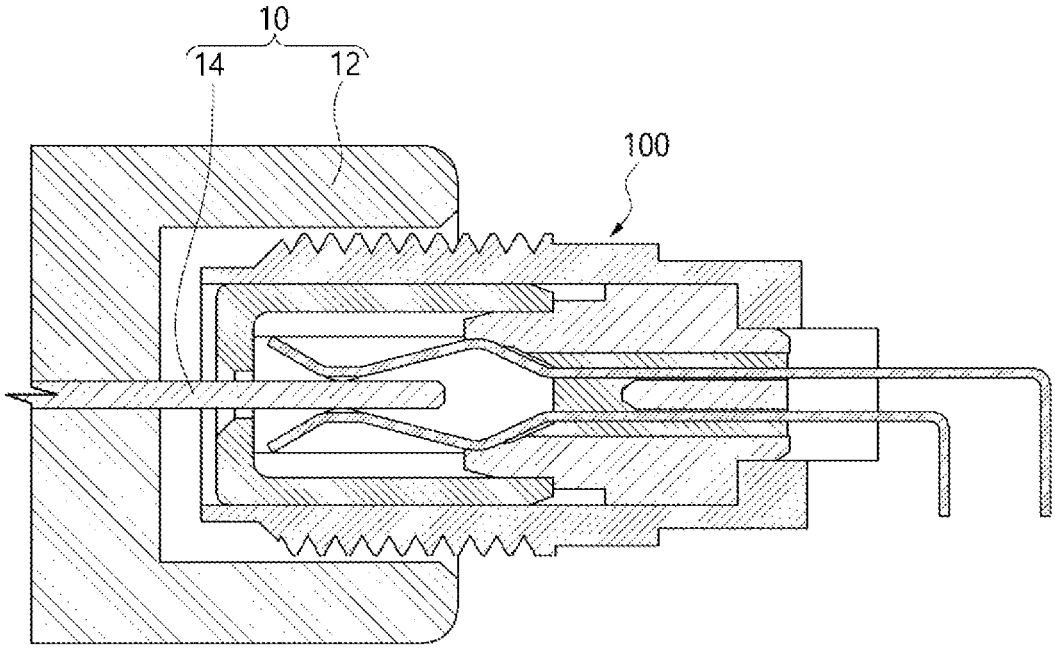
FIG. 3 is a cross-sectional view showing the state after the female connector of FIG. 2 is connected to the male connector.

FIG. 1 is a block diagram showing an electronic device according to a first embodiment of the present invention, FIG. 2 is a sectional view showing the female connector of FIG. 1, and FIG. 3 is a cross-sectional view showing the state after the female connector of FIG. 2 is connected to the male connector.

Referring to FIGS. 1 to 3, an electronic device according to the present embodiment includes a connector module CM which can be coupled with a male connector 10 to receive an input signal, and a signal processing module SM electrically connected to the connector module CM for receiving the input signal to process a signal, which is capable of determining whether the connector module CM is connected with the male connector 10 and indicating the result thereof. On the other hand, the electronic device may be, for example, a TV.

The connector module CM may include a female connector 100 and a connector circuit 200.

The female connector 100 is installed at a body of the electronic device so as to be exposed to the outside and can be coupled with the male connector 10 to receive the input signal from the male connector 10. For example, the female connector 100 may be an F-Jack type female connector as shown in the figure.

The female connector 100 may include a connector body 110, a first terminal engagement pin 120 and a second terminal engagement pin 130. The first terminal engagement pin 120 and the second terminal engagement pin 130 may include a metal capable of transmitting an electrical signal, for example, copper, gold, or silver.

The first terminal engagement pin 120 is disposed inside the connector body 110 and receives the input signal from a connection terminal 14 of the male connector 10 when the first terminal engagement pin 120 contacts the connection terminal 14. The second terminal engagement pin 130 is disposed inside the connector body 110 so as to be spaced apart from the first terminal engagement pin 120.

The first and second terminal engagement pins 120 and 130 may be electrically connected with each other through the connection terminal 14 of the male connector 10, when the connection terminal 14 is inserted between the first and second terminal engagement pins 120 and 130. The first and second terminal engagement pins 120 and 130 may have elasticity so that a distance between the first and second terminal engagement pins 120 and 130 increases when the connection terminal 14 is inserted therebetween and the first and second terminal engagement pins 120 and 130 returns to the original position when the connection terminal is removed.

The connector body 110 may be coupled to the body 12 of the male connector 10 and may include an outer body 112, a pin fixing part 114 and an inner body part 116.

The outer body 112 may have a first opening formed in a first side into which the connection terminal 14 of the male connector 10 is inserted, a second opening formed in a second side opposite to the first side, and an inner space 112*a* formed between the first and second openings. For example, the outer body 112 may be a cylindrical structure having the inner space 112*a*. Accordingly, the body 12 of the male connector 10 can be coupled by wrapping around the outer body 112, and can be coupled by rotation, for example, through a thread.

The pin fixing part 114 may be disposed at the second opening side in the internal space 112*a*, and a portion thereof may be inserted and fixed to the second opening. The first and second terminal engagement pins 120 and 130 may pass through the pin fixing part 114 and may be fixed to the pin fixing part 114. Each of the first and second terminal engagement pins 120 and 130 may have a shape extending from the first opening side through the pin fixing part 114 to extend through the second opening. The first and second terminal engagement pins 120 and 130 may have a curved shape that is symmetrical with respect to each other so that the first and second terminal engagement pins 120 and 130 may be opened when the connection terminal 14 of the male connector 10 is inserted.

The inner body part 116 is disposed at the first opening side in the inner space 112*a*, and one end portion of the inner body part 116 may be inserted between the outer body 112 and the pin fixing part 114 so that the pin fixing part 114 can be fixed. In addition, the inner body part 116 may be formed with a receiving hole for receiving the first and second terminal engagement pins 120 and 130. For example, the inner body part 116 may be a cylindrical structure having the receiving hole, and may be tightly fixed to the inner wall of the outer body 112.

Figure 4:
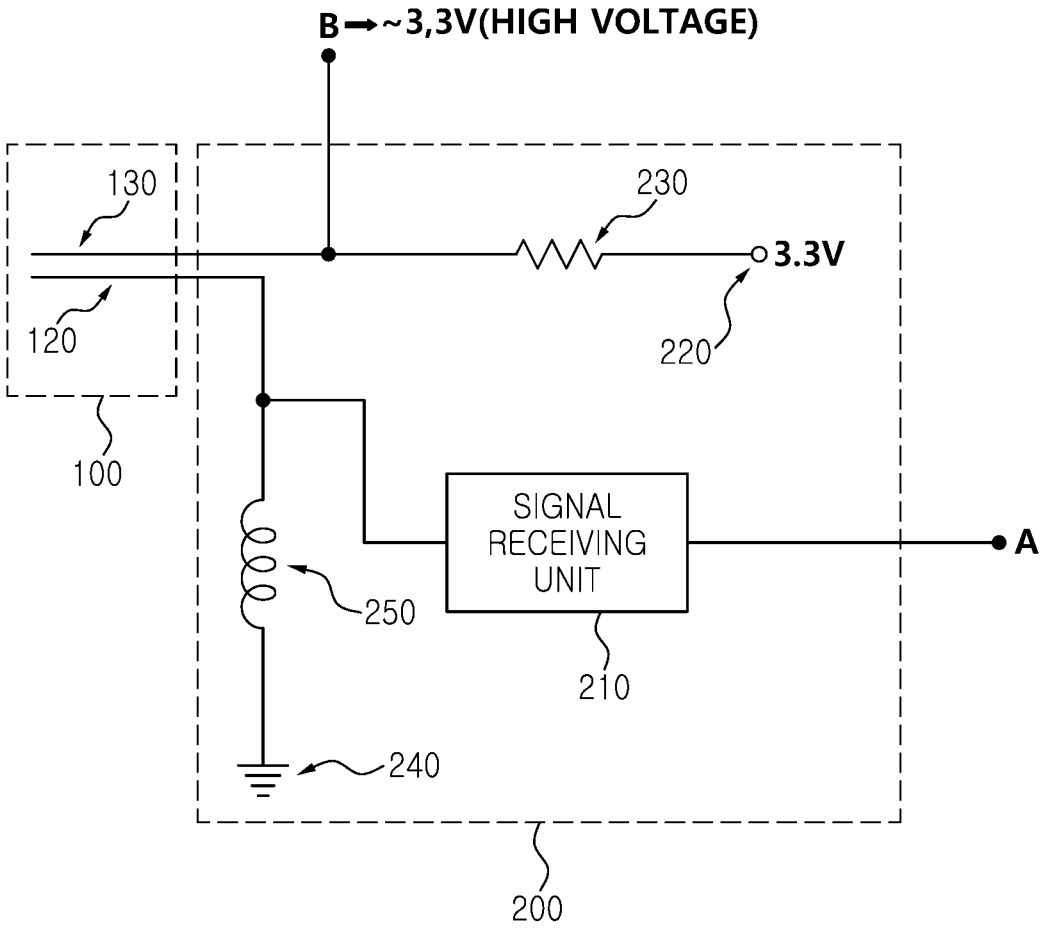
FIG. 4 is a circuit diagram showing the connector module of FIG. 1.
Figure 5:
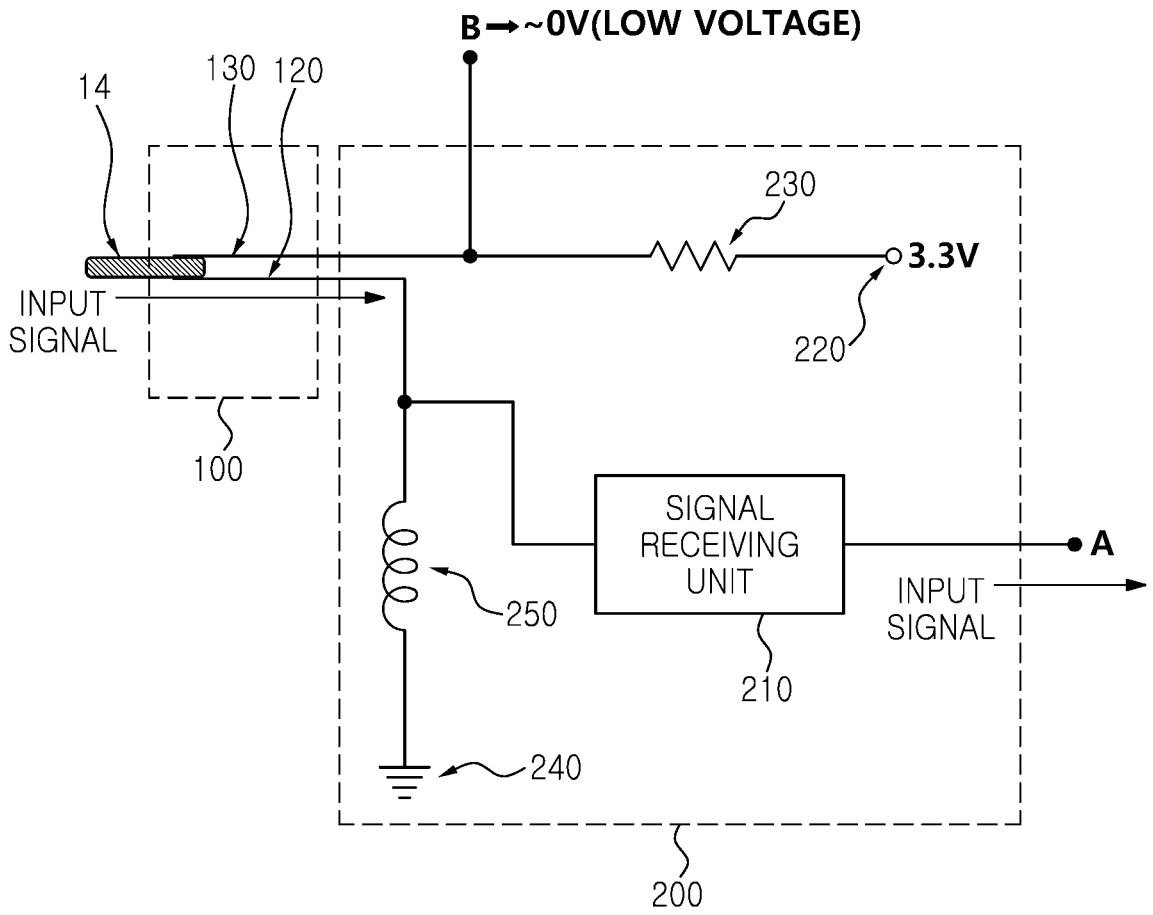
FIG. 5 is a circuit diagram showing a state after the female connector is connected to the male connector in the connector module of FIG. 4.

FIG. 4 is a circuit diagram showing the connector module of FIG. 1, and FIG. 5 is a circuit diagram showing a state after the female connector is connected to the male connector in the connector module of FIG. 4.

Referring to FIGS. 1, 4 and 5, the connector circuit 200 may be electrically connected to the first terminal engagement pin 120 to receive the input signal from the first terminal engagement pin 120, and may transmit the input signal to the signal processing module SM.

Further, the connector circuit 200 may be electrically connected to the second terminal engagement pin 130. The connector circuit 200 can change the voltage generated at the second terminal engagement pin 130 according to connection between the first and second engagement pins 120 and 130, and provide the signal processing module SM with the voltage generated at the second terminal engagement pin 130. In this case, when the second terminal engagement pin 130 is not electrically connected to the first terminal engagement pin 120, a first voltage is formed on the second terminal engagement pin 130. When the engagement pin 130 is electrically connected to the first terminal engagement pin 120 through the connection terminal 14 of the male connector 10, a second voltage different from the first voltage may be formed.

The connector circuit 200 may include a signal receiving unit 210, a power supply unit 220, a resistor unit 230, a ground unit 240 and an inductor unit 250.

The signal receiving unit 210 may be electrically connected to the first terminal engagement pin 120 to receive the input signal from the first terminal engagement pin 120 and transmit the input signal to the signal processing module SM. The signal receiving unit 210 may directly provide the input signal received from the first terminal engagement pin 120 to the signal processing module SM, but may change the level or shape of the input signal to provide the signal processing module SM with the changed input signal.

The power supply unit 220 may be electrically connected to the second terminal engagement pin 130 to provide a DC voltage, for example, a DC voltage of 3.3V.

The resistor unit 230 is disposed between the second terminal engagement pin 130 and the power supply unit 220 to electrically connect the second terminal engagement pin 130 and the power supply unit 220. The resistor unit 230 may have a resistance value of, for example, 100K ohms.

The ground portion 240 may be electrically connected to the first terminal engagement pin 120 to provide a ground voltage, that is, a voltage of 0V.

The inductor unit 250 is disposed between the first terminal engagement pin 120 and the ground unit 240 and electrically connects the first terminal engagement pin 120 and the ground unit 240. The inductor unit 250 may be, for example, a surge coil.

According to the circuit configuration described above, when the second terminal engagement pin 130 is not electrically connected to the first terminal engagement pin 120, a voltage of a high level is formed on the second terminal engagement pin 130 due to the power supply unit 220. When the second terminal engagement pin 130 is electrically connected to the first terminal engagement pin 120 through the connection terminal 14 of the male connector 10, a voltage of a low level is formed on the second terminal engagement pin 130 due to the ground unit 240.

Referring again to FIG. 1, the signal processing module SM may be electrically connected to the connector circuit 200, receive and process the input signal from the connector circuit 200, and indicate whether or not the first and second terminal engagement pins 120 and 130 are connected with each other through the connection terminal 14 of the connector 10.

The signal processing module SM may include a voltage sensing unit 300, an indicating unit 400, and a signal processing unit 500.

The voltage sensing unit 300 is electrically connected to the connector circuit 200. In detail, the voltage sensing unit 300 may be electrically connected to the second terminal engagement pin 130 through the connector circuit 200. The voltage sensing unit 300 senses a voltage formed on the second terminal engagement pin 130, determines whether the female connector 100 is connected with male connector 10 in response to the sensed voltage, and outputs a control signal to the signal processing unit 500.

For example, when the voltage sensing unit 300 senses that the first voltage is formed on the second terminal engagement pin 130, it is determined that the male connector 10 is not properly connected to the female connector 100. On the other hand, when the voltage sensing unit 300 senses that the second voltage is formed on the second terminal engagement pin 130, it is determined that the male connector 10 is properly connected to the female connector 100.

The indicating unit 400 is controlled by the signal processing unit 500 to output light.

The signal processing unit 500 is electrically connected to the signal receiving unit 210 of the connector circuit 200 to receive the input signal and to process a signal to perform an operation in response to the input signal. The signal processor 500 is electrically connected to the voltage sensing unit 300 to receive the control signal and controls the indicating unit 400 to indicate the connection between the female and male connectors in response to the control signal.

In the present embodiment, for example, the indicating unit 400 may include a display device capable of displaying images. At this time, the display device is controlled by the signal processing unit 500 to display an image according to the input signal, or to display whether or not the female and male connectors are connected with each other according to the control signal.

Alternatively, the indicating unit 420 may include a light emitting device such as an LED. At this time, the light emitting device is mounted so as to be exposed to the outside of the body of the electronic device, and can indicate whether or not the female and male connectors are connected with each other according to the control signal. For example, the light emitting device does not output light when the male connector 10 is not connected to the female connector 100, and outputs light for a predetermined time or continuously when the male connector 10 is connected to the female connector 100. The electronic device may further include a separate display device which is controlled by the signal processing unit 500 and can display an image according to the input signal.

Embodiment 2

Figure 6:
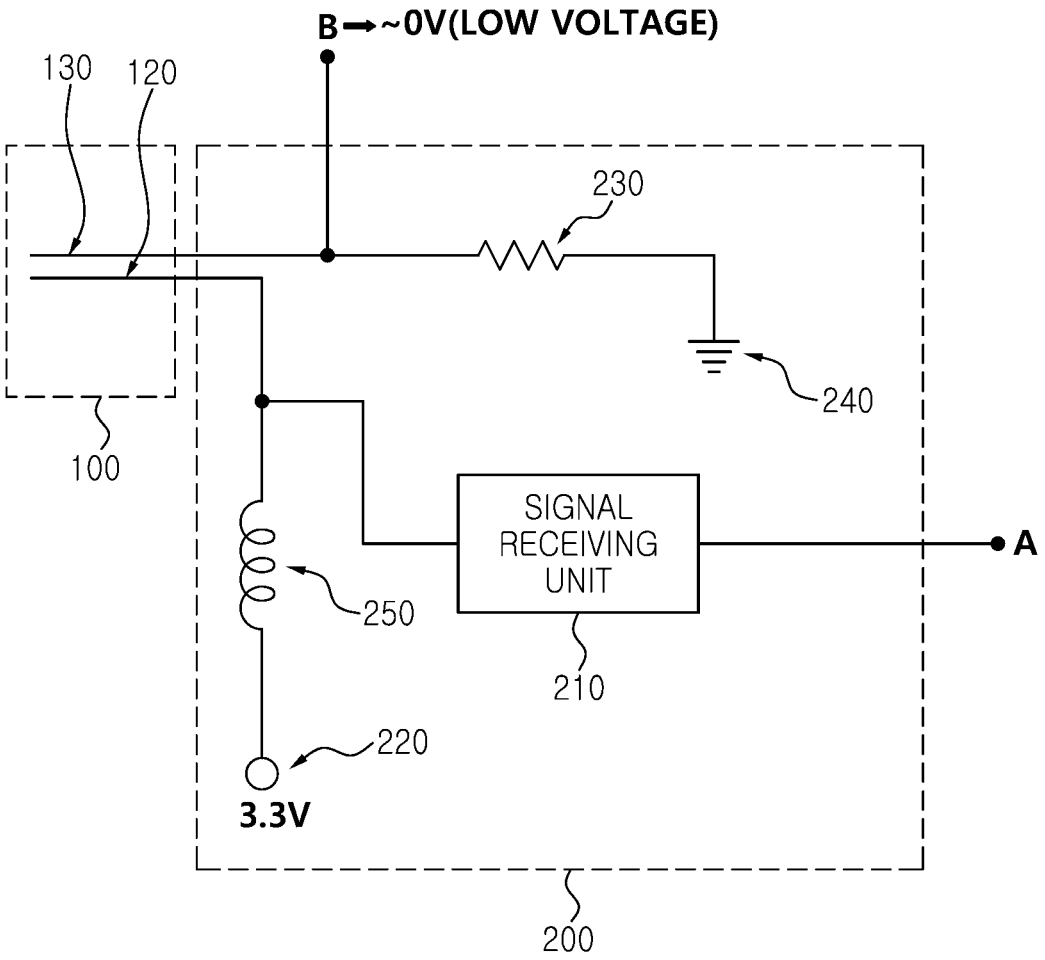
FIG. 6 is a circuit diagram showing a connector module of an electronic device according to a second embodiment of the present invention.
Figure 7:
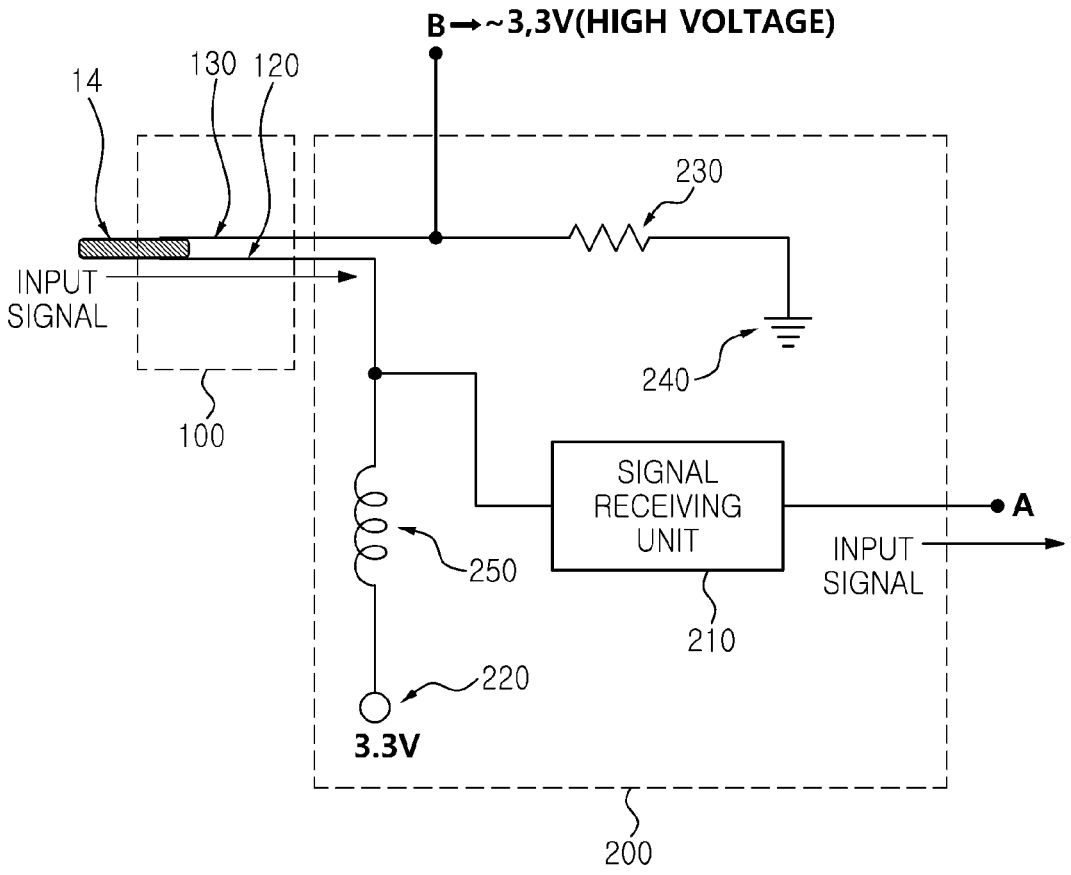
FIG. 7 is a circuit diagram showing a state after the female connector is connected to the male connector in the connector module of FIG. 6.

FIG. 6 is a circuit diagram showing a connector module of an electronic device according to a second embodiment of the present invention, and FIG. 7 is a circuit diagram showing a state after the female connector is connected to the male connector in the connector module of FIG. 6.

The electronic device according to the present embodiment is substantially the same as the electronic device of the first embodiment described with reference to FIGS. 1 to 5 except for the power supply unit 220 and the ground unit 240 of the connector circuit 200. Thus, the same components as those of the first embodiment will be denoted by the same reference numerals and any further explanation for the same components will be omitted.

Referring to FIGS. 6 and 7, the ground unit 240 may be electrically connected to the second terminal engagement pin 130 through the resistor portion 230, and provide the second terminal engagement pin 130 with ground voltage.

The power supply unit 220 may be electrically connected to the first terminal engagement pin 120 through the inductor unit 250, and provide the first terminal engagement pin 120 with a DC voltage, for example 3.3V.

According to the circuit configuration described above, when the second terminal engagement pin 130 is not electrically connected to the first terminal engagement pin 120, a voltage of a low level is formed on the second terminal engagement pin 130 due to the ground unit 240. When the second terminal engagement pin 130 is electrically connected to the first terminal engagement pin 120 through the connection terminal 14 of the male connector 10, a voltage of a high level is formed on the second terminal engagement pin 130 due to the power supply unit 220.

As described above, according to the embodiments, when the connection terminal 14 of the male connector 10 is inserted and coupled between the first and second terminal engagement pins 120 and 130 of the female connector 100, the first and second terminal engagement pins 120 and 130 may be electrically connected through the connection terminal 14 so that the voltage formed on the second terminal engagement pin 130 may be changed. Then, when the voltage sensing unit 300 senses a change in the voltage formed on the second terminal engagement pin 130 to determine whether or not the female connector 100 is connected to the male connector 10, the signal processing unit 500 controls the indicating unit 400 to indicate whether or not the female connector 100 is connected to the male connector 10. Accordingly, a user using the electronic device can easily recognize the connector connection state by checking the indicating unit 400.

It will be apparent to those skilled in the art that various modifications and variation may be made in the present invention without departing from the spirit or scope of the invention. Thus, it is intended that the present invention cover the modifications and variations of this invention provided they come within the scope of the appended claims and their equivalents.

What is claimed is:

1. An electrical connector module comprising:

a female connector comprising a connector body, a first terminal engagement pin disposed inside the connector body and capable of receiving an input signal from a connection terminal of a male connector when the connection terminal is in contact therewith, and a second terminal engaging pin disposed inside the connector body to be spaced apart from the first terminal engaging pin, wherein the first and second terminal engagement pins are electrically connected with each other through the connection terminal when the connection terminal is inserted and coupled between the first and second terminal engagement pins; and a connector circuit electrically connected to each of the first and second terminal engagement pins, wherein a first voltage is formed on the second terminal engagement pin when the second terminal engagement pin is not electrically connected to the first terminal engagement pin, and a second voltage different from the first voltage is formed in the second terminal engagement pin when the second terminal engagement pin is electrically connected to the first terminal engagement pin through the connection terminal, wherein the connector circuit further comprises:

a signal receiving unit electrically connected to the first terminal engagement pin to receive the input signal from the first terminal engagement pin;

a power supply unit for providing a DC voltage;

a resistor unit electrically connecting the second terminal engagement pin and the power supply unit; and a ground unit being electrically connected to and providing a ground voltage to the first terminal engagement pin.

2. The electrical connector module of claim 1, wherein the connector circuit further comprises an inductor unit electrically connecting the first terminal engagement pin and the ground unit.

3. The electrical connector module of claim 2, wherein the first voltage is a high level voltage, and the second voltage is a voltage of a low level.

4. An electronic device comprising:

a connector module comprising:

a female connector comprising a connector body, a first terminal engagement pin disposed inside the connector body and capable of receiving an input signal from a connection terminal of a male connector when the connection terminal is in contact therewith, and a second terminal engaging pin disposed inside the connector body to be spaced apart from the first terminal engaging pin, wherein the first and second terminal engagement pins are electrically connected with each other through the connection terminal when the connection terminal is inserted and coupled between the first and second terminal engagement pins; and a connector circuit electrically connected to each of the first and second terminal engagement pins; and a signal processing module electrically connected to the connector circuit to receive the input signal to process a signal, the signal processing unit being capable of indicating whether or not the female connector is connected to the male connector, wherein the signal processing module further comprises:

a voltage sensing unit electrically connected to the connector circuit to sense a voltage formed on the second terminal engagement pin, and to output a control signal depending on whether or not the female connector is connected to the male connector in response to the sensed voltage;

an indicating unit capable of outputting light; and a signal processing unit capable of processing a signal in response to the input signal provided from the connector circuit and controlling the indicating unit to indicate whether or not the female connector is connected to the male connector in response to the control signal provided from the voltage sensing unit.

5. The electronic device of claim 4, wherein the indicating unit comprises a display device controlled by the signal processing unit and capable of displaying an image according to the input signal or indicating whether or not the female connector is connected to the male connector according to the control signal.

6. The electronic device of claim 4, wherein, a first voltage is formed on the second terminal engagement pin when the second terminal engagement pin is not electrically connected to the first terminal engagement pin, and a second voltage different from the first voltage is formed on the second terminal engagement pin when the second terminal engagement pin is electrically connected to the first terminal engagement pin through the connection terminal.

7. The electronic device of claim 6, wherein the connector circuit comprises:

a signal receiving unit electrically connected to the first terminal engagement pin to receive the input signal from the first terminal engagement pin;

a power supply unit for providing a DC voltage;

a resistor unit electrically connecting the second terminal engagement pin and the power supply unit; and a ground unit being electrically connected to and providing a ground voltage to the first terminal engagement pin.

8. The electronic device of claim 6, wherein the connector circuit comprises:

a signal receiving unit electrically connected to the first terminal engagement pin to receive the input signal from the first terminal engagement pin;

a ground unit providing a ground voltage;

a resistor unit electrically connecting the second terminal engagement pin and the ground unit; and a power supply unit being electrically connected to and providing a DC voltage to the first terminal engagement pin.

* * * * *